US011355868B2

(12) United States Patent
Zhang et al.

(10) Patent No.: US 11,355,868 B2
(45) Date of Patent: Jun. 7, 2022

(54) BOLT TERMINAL

(71) Applicants: Phoenix Contact Asia-Pacific (Nanjing) Co. Ltd, Nanjing (CN); Phoenix Contact GmbH & Co. KG, Blomberg (DE)

(72) Inventors: Tianhua Zhang, Nanjing (CN); Guohua Chen, Nanjing (CN); Michael Reineke, Blomberg (DE)

(73) Assignees: Phoenix Contact Asia-Pacific (Nanjing) Co., Ltd., Nanjing (CN); Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 16/976,004

(22) PCT Filed: Mar. 22, 2019

(86) PCT No.: PCT/CN2019/079202
§ 371 (c)(1),
(2) Date: Aug. 26, 2020

(87) PCT Pub. No.: WO2019/184806
PCT Pub. Date: Oct. 3, 2019

(65) Prior Publication Data

US 2021/0044033 A1 Feb. 11, 2021

(30) Foreign Application Priority Data

Mar. 27, 2018 (CN) ..... 201820416803.9

(51) Int. Cl.
*H01R 13/46* (2006.01)
*H01R 4/30* (2006.01)
(Continued)

(52) U.S. Cl.
CPC ..... *H01R 4/30* (2013.01); *H01R 4/70* (2013.01); *H01R 9/16* (2013.01)

(58) Field of Classification Search
CPC ..... H02G 5/08; H01H 71/02; H01H 71/10; H01R 25/142
(Continued)

(56) References Cited

U.S. PATENT DOCUMENTS 5,333,978 A * 8/1994 Rives ..... B60Q 1/0433 411/369
5,836,791 A * 11/1998 Waas ..... H01R 9/2641 439/709
8,469,737 B2 6/2013 Correll et al.

FOREIGN PATENT DOCUMENTS

CN 101764293 A 4/2009
CN 201392894 Y 1/2010
(Continued)

OTHER PUBLICATIONS

International Search Report and Written Opinion dated Oct. 3, 2019 from counterpart International Application No. PCT/CN2019/079202, 11 pp.
(Continued)

*Primary Examiner* — Phuong Chi Thi Nguyen
(74) *Attorney, Agent, or Firm* — Shumaker & Sieffert, P.A.

(57) ABSTRACT

A bolt terminal mounted on a guide rail is provided. The bolt terminal comprises a housing (1), an integral nut (2), a screw (3), a connection component (4), and a wiring metal surface (5); one end of the screw is provided in the housing, the other end of the screw is located outside the housing, and the screw located outside the housing is to be connected to the integral nut fitted therewith; the wiring metal surface is provided on the interface between the screw and the housing; and the housing is to be connected to the guide rail via
(Continued)

the connection component. The bolt terminal increases the requirement for powering the wirings, and the bolt terminal can be removed from the guide rail only by using a conventional screwdriver to lightly tap on a removal port. The screw is integrally connected to the housing by injection molding and thus there is no risk of the screw falling off, enabling higher reliability.

11 Claims, 2 Drawing Sheets

(51) Int. Cl.
*H01R 4/70* (2006.01)
*H01R 9/16* (2006.01)

(58) Field of Classification Search
USPC ..... 174/520, 72 R
See application file for complete search history.

(56) References Cited

FOREIGN PATENT DOCUMENTS

| | | | |
|---|---|---|---|
| CN | 202167627 | U | 3/2012 |
| CN | 205406801 | U | 7/2016 |
| CN | 208157658 | U | 11/2018 |
| DE | 2845670 | A1 | 4/1980 |
| JP | 2012204344 | A | 10/2012 |
| JP | 2017117604 | A | 6/2017 |
| KR | 101250183 | B1 | 4/2013 |

OTHER PUBLICATIONS

International Preliminary Report on Patentability dated Oct. 8, 2020 from counterpart International Application No. PCT/CN2019/079202, 13 pp.
Notice of Reasons for Refusal, and machine translation thereof, from counterpart Japanese Application No. 2020-551466, dated Nov. 1, 2021, 8 pp.
Extended Search Report from counterpart European Application No. 19776596.9, dated Nov. 18, 2021, 8 pp.

* cited by examiner

BOLT TERMINAL

This application is a national stage application under 35 U.S.C. § 371 of PCT Application No. PCT/CN2019/079202, filed Mar. 22, 2019, which claims the benefit of China Application No. 201820416803.9, filed Mar. 27, 2018. The entire contents of each of PCT Application No. PCT/CN2019/079202 and China Application No. 201820416803.9 are incorporated herein by reference in their entireties.

FIELD

The present disclosure relates to a wiring terminal, and more particularly to a bolt terminal.

BACKGROUND

In order to meet the wiring requirement for large wire diameters, the existing bolt terminals usually have a large volume. During the installation process, the bolt terminals are usually connected to the guide rail by way of snapping. During the connection process, requirement for the design of the snapping grooves are relatively high, or the bolt terminals are snapped with the guide rail using pins and springs, so that the entirety of the terminal must be pulled to make the guide rail compress the springs at the bottom of the terminals and then take out the same when disassembling or assembling. Thus, it is inconvenient to operate as described above for the terminal buses where a large amount of wiring has been completed, resulting in serious waste of human resources.

In addition, the existing bolt terminals usually use cold junctions to contact each other so as to achieve conduction. If a large current needs to flow through the bolt terminal, the existing cold junction contact method cannot meet the wiring powering requirement.

SUMMARY

The purpose of the present disclosure is to provide a bolt terminal with a compact structure which enables the requirement for connecting relatively large wire diameters.

In order to achieve said purpose, a bolt terminal of the present disclosure mounted on a guide rail includes a housing, an integral nut, a screw, a connection component, and a wiring metal surface, wherein:

One end of the screw is provided in the housing, and the other end of the screw is located outside the housing, wherein the screw located outside the housing is connected to an integral nut fitted therewith;

A wiring metal surface is provided on the interface between the screw and the housing;

The housing is to be connected to the guide rail via a connection component.

Further, the vertical distance of the upper surface of said wiring metal surface relative to the guide rail is higher than or equal to the vertical distance of the upper surface interfaced with the housing relative to the guide rail.

Further, said connection component includes a first groove provided at one end of the housing that contacts one end of the guide rail, and a mounting component provided at the other end of the guide rail that contacts the other end of the guide rail, wherein the mounting component includes a guide rail mounting foot connected to the housing, and a spring provided between the housing and the guide rail mounting foot.

Further, the bottom of the housing is provided with a mounting component connection cavity, wherein mounting grooves opposite to each other are provided at both side end faces of the mounting component connection cavity, the mounting grooves are connected to the guide rail mounting foot, and wherein a spring seat cavity is provided in the mounting component connection cavity, and the spring is provided in the spring seat cavity.

Further, said guide rail mounting foot includes a bottom surface, L-shaped bent portions, a removal port, a spring lock portion, and a guide rail connection portion, wherein:

The removal port passes through the bottom surface, and is located at an end away from the guide rail connection portion;

The spring lock portion is L-shaped and is proximate to the guide rail connection portion;

The L-shaped bent portions are connected to the bottom surface and are provided oppositely on both sides of the bottom surface; the L-shaped bent portion is provided in a mounting groove provided on the mounting component connection cavity;

The guide rail connection portion is to be connected to the guide rail.

Further, said L-shaped bent portions includes a first bent portion and a second bent portion, wherein a transition portion is provided between the first bent portion and the second bent portion, and wherein the transition portion is a plane which is perpendicular to the bottom surface and intersects with the bottom surface.

Further, said guide rail connection portion is a bevel.

Further, a spring mounting cavity is provided between said removal port and the spring lock portion.

Further, a second groove corresponding to the length of the first bent portion is provided on said mounting groove.

Further, said screw is a profiled screw, and a cross-section of the screw located in the housing is a trapezoidal structure, and the diameter at the bottom of the screw is the largest.

From the above technical contents, it can be seen that a wiring metal surface is provided on the interface between the screw and the housing of the bolt terminal of the present disclosure. The wiring metal surface increases the conductive area and increases the requirement for powering the wirings.

A spring is provided in the guide rail mounting cavity. When mounting the bolt terminal, the bolt terminal can be easily mounted on the guide rail due to the bevel provided in the front of the guide rail connection portion; when removing the bolt terminal, since a removal port is provided on the bottom of the guide rail mounting cavity, the bolt terminal can be removed from the guide rail only by using a conventional screwdriver to lightly tap on a removal port.

The screw is a profiled screw, and the cross-section of the screw located in the housing is a trapezoidal structure, and the diameter at the bottom of the screw is the largest. During the manufacturing process, the screw is integrally connected to the housing by injection molding and thus there is no risk of the screw falling off, enabling higher reliability.

It should be understood that all combinations of the foregoing concepts and additional concepts described in more detail below can be considered as a part of the inventive subject matter of the present disclosure as long as such concepts do not contradict each other. In addition, all combinations of the claimed subject matter are regarded as a part of the inventive subject matter of the present disclosure.

The foregoing and other aspects, embodiments, and features of the teachings of the present disclosure can be more comprehensively understood from the following description in conjunction with the accompanying drawings. Other additional aspects of the present disclosure, such as features and/or beneficial effects of the exemplary embodiments, will be apparent from the following description, or will be known from the practice of specific embodiments according to the teachings of the present disclosure.

BRIEF DESCRIPTION OF THE DRAWINGS

The drawings are not intended to be drawn to scale. In the drawings, each of the identical or approximately identical components shown in each FIG., can be denoted by the same reference number. For clarity, not each component is labeled in each drawing. Now, embodiments of various aspects of the present disclosure will be described by way of examples and with reference to the drawings, in which.

The names of the relevant reference numbers in the FIGS. are as follows: 1, housing; 2, integral nut; 3, screw; 4, connection portion; 5, wiring metal surface; 6, mounting component; 7, first groove; 8, guide rail mounting foot; 9, spring; 10, mounting component connection cavity; 11, spring seat cavity; 12, bottom surface; 13, L-shaped bent portion; 14, removal port; 15, spring lock portion; 16, guide rail connection portion; 17, first bent portion; 18, second bent portion; 19, transition portion; 20, spring mounting cavity; 21, second groove; 22, first spring positioning boss; 23, second spring positioning boss.

DETAILED DESCRIPTION

In order to understand the technical contents of the present disclosure better, specific embodiments are particularly listed and described below in combination with the accompanying drawings.

Various aspects of the disclosure are described in the present disclosure with reference to the accompanying drawings, in which many embodiments described herein are shown. The embodiments of the present disclosure are not necessarily intended to include all aspects of the present discolor. It should be understood that the various concepts and embodiments introduced above, as well as those concepts and embodiments described in more detail below, can be implemented in any of various ways, because the concepts and embodiments disclosed in the present disclosure are not limited to any implementation. Further, some aspects disclosed in the present disclosure can be used alone, or in combination with any suitable combinations of other aspects disclosed in the present disclosure.

Embodiment 1

Figure 1:
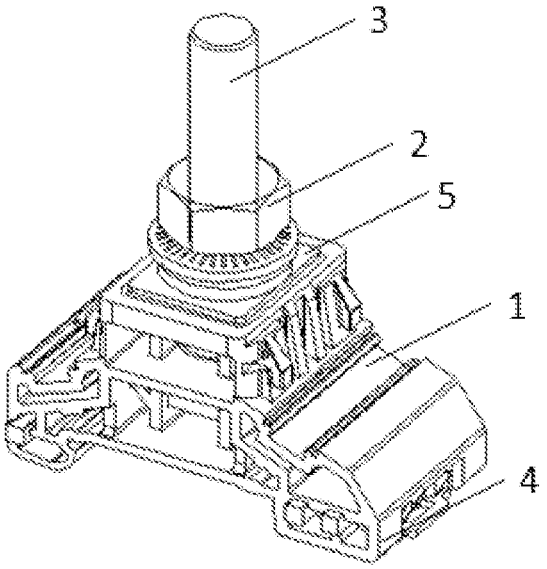
FIG. 1 is a schematic view of the structure of the bolt terminal of the present disclosure.

As shown in FIG. 1, a bolt terminal to be mounted on a guide rail includes a housing 1, an integral nut 2, a screw 3, a connection component 4, and a metal wiring surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail via the connection component 4.

Embodiment 2

Figure 2:
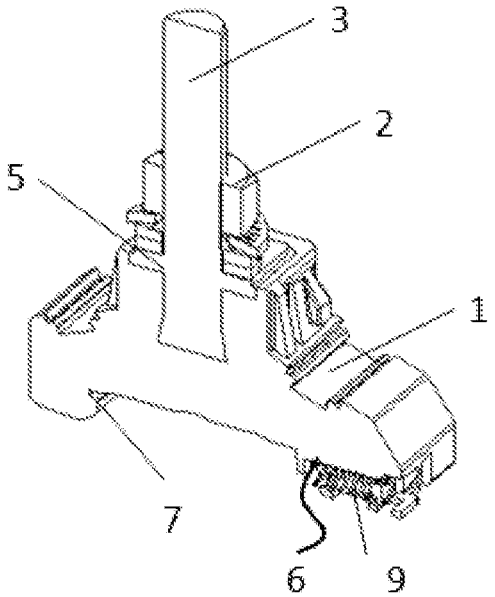
FIG. 2 is a cross-sectional view of FIG. 1 of the present disclosure.
Figure 3:
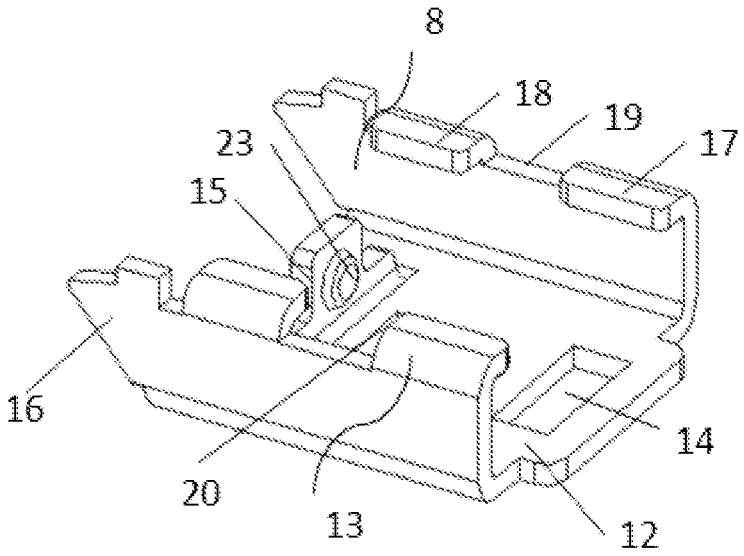
FIG. 3 is a schematic view of the structure of the guide rail mounting foot of the present disclosure.
Figure 4:
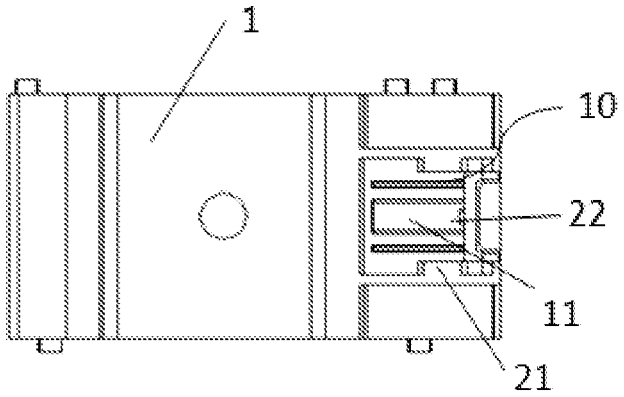
FIG. 4 is a bottom view of the bolt terminal of FIG. 1 with the mounting component having been taken out.

Referring to FIG. 1 and FIG. 2, a bolt terminal to be mounted on the guide rail includes a housing 1, an integral nut 2, a screw 3, a connection component 4, and a wiring metal surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail via the connection component 4. The vertical distance of the upper surface of the wiring metal surface 5 relative to the guide rail is higher than or equal to the vertical distance of the upper surface interfacing with the housing 1 relative to the guide rail, wherein the wiring metal surface 5 can be provided with a stepped surface, the lower stepped surface is in the same horizontal plane as the upper surface of the housing 1, and the surface of the wiring metal surface 5 that contacts the cold junction is higher than the upper surface of the housing 1. In this manner, it can be ensured that the surfaces of the cold junction in contact with the bolt terminal are all metal surfaces, which provides powering efficiency.

Embodiment 3

Referring to FIGS. 1, 2, 3, and 4, a bolt terminal to be mounted on the guide rail includes a housing 1, an integral nut 2, a screw 3, a connection component 4, and a wiring metal surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail via the connection component 4. The vertical distance of the upper surface of the wiring metal surface 5 relative to the guide rail is higher than or equal to the vertical distance of the upper surface interfacing with the housing 1 relative to the guide rail, wherein the wiring metal surface 5 can be provided with a stepped surface, the lower stepped surface is in the same horizontal plane as the upper surface of the housing 1, and the surface of the wiring metal surface 5 that contacts the cold junction is higher than the upper surface of the housing 1. In this manner, it can be ensured that the surfaces of the cold junction in contact with the bolt terminal are all metal surfaces, which provides powering efficiency.

The connection component 4 includes a first groove 7 provided at one end of the housing 1 in contact with one end of the guide rail, and a mounting component 6 provided at the other end of the guide rail in contact with the other end of the guide rail. The mounting component 6 includes a guide rail mounting foot 8 connected to the housing 1, and a spring 9 provided between the housing 1 and the guide rail mounting foot 8, wherein a first positioning boss 22 is provided at a corresponding position of the housing 1, and the first spring positioning boss 22 makes the spring 9 fixed relative to the housing 1. During the process of use and installation, the groove is connected to the guide rail, and the guide rail mounting foot 8 is connected to the guide rail by means of the spring 9, so as to realize the reliable connection between the housing 1 and the guide rail.

Embodiment 4

As shown in FIGS. 1, 2, 3 and 4, a bolt terminal to be mounted on the guide rail includes a housing 1, an integral nut 2, a screw 3, a connection component 4, and a wiring metal surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail by the connection component 4.

The connection component 4 includes a first groove 7 provided at one end of the housing 1 in contact with one end of the guide rail, and a mounting component 6 provided at the other end of the guide rail in contact with the other end of the guide rail. The mounting component 6 includes a guide rail mounting foot 8 connected to the housing 1, and a spring 9 provided between the housing 1 and the guide rail mounting foot 8, wherein a first spring positioning boss 22 is provided at a corresponding position of the housing 1, and the first positioning boss 22 makes the spring 9 fixed relative to the housing 1. During the process of use and installation, the groove is connected to the guide rail, and the guide rail mounting foot 8 is connected to the guide rail by means of the spring 9, so as to realize the reliable connection between the housing 1 and the guide rail.

Embodiment 5

Referring to FIGS. 1, 2, 3, and 4, a bolt terminal to be mounted on the guide rail includes a housing 1, an integral nut 2, a screw 3, a connection component 4, and a wiring metal surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail via the connection component 4. The vertical distance of the upper surface of the wiring metal surface 5 relative to the guide rail is higher than or equal to the vertical distance of the upper surface interfacing with the housing 1 relative to the guide rail, wherein the wiring metal surface 5 can be provided with a stepped surface, the lower stepped surface is in the same horizontal plane as the upper surface of the housing 1, and the surface of the wiring metal surface 5 that contacts the cold junction is higher than the upper surface of the housing 1. In this manner, it can be ensured that the surfaces of the cold junction in contact with the bolt terminal are all metal surfaces, which provides powering efficiency.

The connection component 4 includes a first groove 7 provided at one end of the housing 1 in contact with one end of the guide rail, and a mounting component 6 provided at the other end of the guide rail in contact with the other end of the guide rail. The mounting component 6 includes a guide rail mounting foot 8 connected to the housing 1, and a spring 9 provided between the housing 1 and the guide rail mounting foot 8, wherein a first spring positioning boss 22 is provided at a corresponding position of the housing 1, and the first positioning boss 22 makes the spring 9 fixed relative to the housing 1. During the process of use and installation, the groove is connected to the guide rail, and the guide rail mounting foot 8 is connected to the guide rail by means of the spring 9, so as to realize the reliable connection between the housing 1 and the guide rail. A mounting component connection cavity 10 is provided at bottom of the housing 1. Mounting grooves are provided oppositely on both side end faces of the mounting component connection cavity 10. The mounting grooves are connected to the guide rail mounting foot 8, wherein a spring seat cavity 11 is provided in the mounting component connection cavity 10, and the spring 9 is provided in the spring seat cavity 11.

Embodiment 6

Referring to FIGS. 1, 2, 3, and 4, a bolt terminal to be mounted on the guide rail includes a housing 1, an integral nut 2, a screw 3, a connection component 4, and a wiring metal surface 5, wherein: one end of the screw 3 is provided in the housing 1, and the other end of the screw 3 is located outside the housing 1, wherein the screw 3 located outside the housing 1 is connected to the integral nut 2 fitted therewith; a wiring metal surface 5 is provided on the interface between the screw 3 and the housing 1; the housing 1 is to be connected to the guide rail via the connection component 4. The vertical distance of the upper surface of the wiring metal surface 5 relative to the guide rail is higher than or equal to the vertical distance of the upper surface interfacing with the housing 1 relative to the guide rail, wherein the wiring metal surface 5 can be provided with a stepped surface, the lower stepped surface is in the same horizontal plane as the upper surface of the housing 1, and the surface of the wiring metal surface 5 that contacts the cold junction is higher than the upper surface of the housing 1. In this manner, it can be ensured that the surfaces of the cold junction in contact with the bolt terminal are all metal surfaces, which provides powering efficiency.

The connection component 4 includes a first groove 7 provided at one end of the housing 1 in contact with one end of the guide rail, and a mounting component 6 provided at the other end of the guide rail in contact with the other end of the guide rail. The mounting component 6 includes a guide rail mounting foot 8 and a spring 9. A mounting component connection cavity 10 is provided at bottom of the housing 1. Mounting grooves are provided oppositely on both side end faces of the mounting component connection cavity 10. The mounting grooves are connected to the guide rail mounting foot 8, wherein a spring seat cavity 11 is provided in the mounting component connection cavity 10, and the spring 9 is provided in the spring seat cavity 11.

The guide rail mounting foot 8 include a bottom surface 12, L-shaped bent portions 13, a removal port 14, a spring lock portion 15, and a guide rail connection portion 16, wherein: the removal port 14 pass through the bottom surface 12 and is located at an end away from the guide rail connection portion 16; the spring lock portion 15 is L-shaped and is proximate to the guide rail connection portion 16; the L-shaped bent portions 13 are connected to the bottom surface 12 and are provided oppositely on both sides of the bottom surface 12; the L-shaped bent portions 13 are provided in the mounting groove provided on the mounting component connection cavity 10; the guide rail connection portion 16 is to be connected to the guide rail.

A second spring positioning boss 23 is provided on the spring lock portion 15, wherein a first spring positioning boss 22 is provided at a corresponding position of the housing 1. The first spring positioning boss 22 and the second spring positioning boss 23 makes the spring 9 fixed relative to the housing 1. The above-mentioned first spring positioning boss 22 and second spring positioning boss 23 are optional technical features.

Embodiment 7

On the basis of Embodiment 6, the guide rail mounting foot 8 is further optimized. The L-shaped bent portion 13 includes a first bent portion 17 and a second bent portion 18, wherein a transition portion 19 is provided between the first bent portion 17 and the second bent portions 18, and wherein the transition portion 19 is a plane which is perpendicular to the bottom surface 12 and intersects with the bottom surface 12. In this manner, in addition to the existing mounting method, a transition portion 19 is added, which provides a support for later modification to the mounting method.

Embodiment 8

On the basis of Embodiment 7 or Embodiment 6, the shape of the guide rail connection portion 16 is defined. That is, the guide rail connection portion 16 is a bevel. When such structure is used, the bevel can make the guide rail mounting foot 8 at the bottom of the bolt terminal be snapped into the guide rail along the direction of the bevel during the process of connecting the bolt terminal with the guide rail, without the need of pressing the spring 9 in the guide rail mounting foot 8 as much as possible to achieve the connection between the bolt terminal and the guide rail, resulting in increased mounting efficiency.

Embodiment 9

On the basis of Embodiment 8, a spring mounting cavity 20 is added. That is, a spring mounting cavity 20 is provided between the removal port 14 and the spring lock portion 15. In this manner, during the mounting process, there is no need to mount the spring 9 in the guide rail mounting foot 8 in advance. The guide rail mounting foot 8 can be mounted at the bottom of the housing 1 first, and the above-mentioned spring 9 can be mounted between the spring lock portion 15 and the housing 1 via the spring mounting cavity 20.

Embodiment 10

On the basis of Embodiment 9, a second groove 21 corresponding to the length of the first bent portion 17 is provided on the mounting groove. During the installation process, the first bent portion 17 of the guide rail mounting foot 8 passes through the second groove 21 and fits with the mounting groove provided on the housing 1 to realize the installation of the guide rail mounting foot 8.

At the same time, all the screws 3 in each of the above-mentioned embodiments of the bolt terminal can be profiled screws 3, and the cross-section of the screw 3 located within the housing 1 is a trapezoidal structure, and the diameter at the bottom of the screw 3 is the largest. Since the diameter at the bottom of the screw 3 is the largest, the over molding technology is used to fix the bolt to the housing 1 during the manufacture of the bolt terminal, and will not fall off during the use.

The bolt terminal of the disclosure connects the groove provided at the bottom of the housing 1 with one end of the guide rail. By pressing down the bolt terminal, the bevel provided on the guide rail mounting foot 8 contacts the guide rail, and the guide rail mounting foot 8 provide the spring with a squeezing force by means of the guide rail, and the spring 9 is squeezed to move toward the removal port 14, so that the guide rail mounting foot 8 snaps onto the guide rail.

A gasket is provided between the integral nut 2 and the wiring metal surface 5 of the present disclosure, wherein the gaskets can be provided with one or two.

As can be seen from the above technical solutions, a wiring metal surface 5 is provided on the interface between the screw 3 and the housing 1 of the bolt terminal of the present disclosure. The connection metal surface 5 increases the conductive area and increases the requirement for powering the wirings.

A spring 9 is provided in the guide rail mounting cavity. When mounting the bolt terminal, since a bevel is provided in the front of the guide rail connection portion 16, the bolt terminal can be easily mounted on the guide rail; when removing the bolt terminal, since a removal port 14 is provided on the ground of the guide rail mounting cavity, the bolt terminal can be removed from the guide rail only by using a conventional screwdriver to lightly tap on a removal port 14.

The screw 3 is a profiled screw 3, and the cross-section of the screw 3 located within the housing 1 is a trapezoidal structure, and the diameter at the bottom of the screw 3 is the largest. During the manufacturing, the screw 3 is integrally connected to the housing 1 by injection molding and thus there is no risk of the screw falling off, enabling higher reliability.

Though the present disclosure has been disclosed as above with preferred embodiments, it is not intended to limit the present disclosure. Those skilled in the art can make various modifications and retouching without departing from the spirit and scope of the present disclosure. Therefore, the protection range of the present disclosure shall be subject to those defined in the claims.

What is claimed is:

1. A bolt terminal assembly configured to be mounted on a guide rail, the bolt terminal comprising:

a housing;

an integral nut;

a screw defining a first end and a second end, the first end disposed in the housing and the second end disposed outside of the housing, wherein the second end of the screw outside of the housing is fitted to the integral nut;

a connection component, wherein the housing is configured to be connected to the guide rail via the connection component; and a wiring metal surface disposed on an interface between the screw and the housing, wherein the wiring metal surface is external to the housing, and wherein the bolt terminal is configured such that a vertical distance of the wiring metal surface relative to the guide rail is greater than or equal to a vertical distance of an upper surface of the housing relative to the guide rail when the housing is connected to the guide rail via the connection component.

2. The bolt terminal assembly of claim 1, wherein the wiring metal surface comprises a stepped surface on the interface, such that a lower portion of the stepped surface is in a same horizontal plane as the upper surface of the housing, and wherein a portion of the wiring metal surface that is configured to contact a cold junction is higher than the upper surface of the housing.

3. The bolt terminal assembly of claim 1, wherein the screw is a profiled screw, and a cross-section of the first end of the screw located within the housing is a trapezoid structure, and wherein a largest diameter of the trapezoid structure is furthest from the wiring metal surface.

4. The bolt terminal assembly of claim 1, wherein the screw is integral.

5. The bolt terminal assembly of claim 1, wherein the connection component comprises a first groove disposed at one end of the housing, the first groove being configured to be in contact with one end of the guide rail, and a mounting component disposed provided at the other end of the housing, the mounting component being configured to be in contact with the other end of the guide rail when the first groove is in contact with the one end of the guide rail, wherein the mounting component includes a rail mounting foot and a spring, the rail mounting foot being connected to the housing, and the spring being positioned between the housing and the guide rail mounting foot.

6. The bolt terminal assembly of claim 5, wherein a mounting component connection cavity is provided at a bottom of the housing, mounting grooves are provided oppositely on both side end faces of the mounting component connection cavity, and the mounting grooves are connected to the rail mounting foot, and wherein a spring seat cavity is disposed in the component connection cavity, and the spring is disposed in the spring seat cavity.

7. The bolt terminal assembly of claim 6, wherein the rail mounting foot comprises a bottom surface, L-shaped bent portions, a removal port, a spring lock portion, and a guide rail connection portion, wherein:

the removal port passes through the bottom surface, and is located at an end away from the guide rail connection portion;

the spring lock portion is L-shaped and is proximate to the guide rail connection portion;

the L-shaped bent portions are connected to the bottom surface and are disposed oppositely on both sides of the bottom surface;

the L-shaped bent portions are disposed in mounting grooves disposed on the mounting component connection cavity; and the guide rail connection portion is to be connected to the guide rail.

8. The bolt terminal assembly of claim 7, wherein the guide rail connection portion is a bevel.

9. The bolt terminal assembly of claim 7, wherein a spring mounting cavity is provided between the removal port and the spring lock portion.

10. The bolt terminal assembly of claim 7, wherein the L-shaped bent portion include a first bent portion and a second bent portion, wherein a transition portion is disposed between the first bent portion and the second bent portion, and wherein the transition portion is a plane which is perpendicular to the bottom surface and intersects with the bottom surface.

11. The bolt terminal assembly of claim 10, wherein a second groove corresponding to a length of the first bent portion is provided on the mounting grooves.

* * * * *